US006986829B2

(12) United States Patent
Gehr et al.

(10) Patent No.: US 6,986,829 B2
(45) Date of Patent: Jan. 17, 2006

(54) PROCESS AND CONTAINER FOR STACKING HIGH-CONSISTENCY STOCK

(75) Inventors: Volker Gehr, Baienfurt (DE); Martin Nuber, Lindau (DE)

(73) Assignee: Voith Paper Patent GmbH, Heidenheim (DE)

( * ) Notice: Subject to any disclaimer, the term of this patent is extended or adjusted under 35 U.S.C. 154(b) by 316 days.

(21) Appl. No.: 10/292,468

(22) Filed: Nov. 13, 2002

(65) Prior Publication Data

US 2003/0089471 A1 May 15, 2003

(30) Foreign Application Priority Data

Nov. 15, 2001 (DE) ..... 101 56 201

(51) Int. Cl.
*D21D 5/28* (2006.01)

(52) U.S. Cl. ..... 162/57; 162/17; 162/18; 162/52; 209/155

(58) Field of Classification Search ..... 162/4, 162/55–59, 52, 243, 380, 17–19, 182, 246, 162/248, 249; 209/255, 273, 306, 356, 379, 209/132, 155, 158–161, 913, 933; 137/544–550
See application file for complete search history.

(56) References Cited

U.S. PATENT DOCUMENTS 3,293,117 A * 12/1966 Rich et al. ..... 162/236
4,443,296 A * 4/1984 Lamort ..... 162/52
4,538,765 A * 9/1985 Mayr et al. ..... 241/21
4,818,339 A * 4/1989 Lamort ..... 162/4
5,106,456 A * 4/1992 Voitto et al. ..... 162/17
5,407,538 A 4/1995 Lamort
5,538,597 A * 7/1996 Koso et al. ..... 162/246

FOREIGN PATENT DOCUMENTS

| | | |
|---|---|---|
| DE | 3522395 | 11/1986 |
| DE | 19826879 | 12/1999 |
| EP | 0323749 | 7/1989 |
| EP | 0475669 | 3/1992 |

* cited by examiner

*Primary Examiner*—Dionne A. Walls
*Assistant Examiner*—Eric Hug
(74) *Attorney, Agent, or Firm*—Greenblum & Bernstein, P.L.C.

(57) ABSTRACT

Process and container for stacking and diluting paper fiber stock. The process includes stacking a high-consistency stock in a first volume for defined dwell time, conveying stock to second volume arranged to adjoin downstream first volume, diluting stock in second volume at least to a pumpable consistency, and drawing off diluted stock as suspension through a wire. Process includes generating circulation flow in second volume, such that circulation flow facilitates conveying of stock located on boundary of first volume into second volume, diluting stock, and drawing stock through wire. Process includes rotating rotor to keep wire clear, and generating, with screw coil arranged directly in front of rotor, flow that runs in axial direction of screw coil and guides diluted suspension away from wire. The instant abstract is neither intended to define the invention disclosed in this specification nor intended to limit the scope of the invention in any way.

13 Claims, 3 Drawing Sheets

PROCESS AND CONTAINER FOR STACKING HIGH-CONSISTENCY STOCK

CROSS-REFERENCE TO RELATED APPLICATIONS

The present application claims priority under 35 U.S.C. §119 of German Patent Application No. 101 56 201.2, filed Nov. 15, 2001, the disclosure of which is expressly incorporated by reference herein in its entirety.

BACKGROUND OF THE INVENTION

1. Field of the Invention

The invention relates to a process for stacking and diluting paper fiber stock which is stacked in a high-consistency condition in a first volume during a defined dwell time and subsequently conveyed to a second volume which adjoins downstream the first volume, in which the paper stock is diluted at least until it is pumpable and is drawn off as a suspension through a wire. The second volume generates a circulation flow that carries away the high-consistency paper fiber stock located on the edge of the first volume, dilutes it and conveys it to a wire, which is kept clear by a rotating rotor.

2. Discussion of Background Information

Methods of this type are used to stack paper fiber stock which has already been disintegrated and has a dry matter content of, e.g., between about 20 and about 40%, such that it remains in this condition for a desired dwell time in order, e.g., to store the fiber stock or to allow a chemical reaction to occur. As a rule, a container is used to hold the paper fiber stock. It is known that for many chemical reactions a minimum dwell time is necessary, whereby there are also cases in which it is essential not to exceed or fall below the dwell time, where it must therefore lie within a certain range. A typical application is bleaching high-consistency paper fiber stock. In principle, a higher consistency is aimed at there, firstly so as to keep the required volume as small as possible, and secondly to promote the effectiveness of the chemical reaction. As a rule, a temperature is set at considerably higher than the surroundings.

In most cases the paper fiber stock in the stacking consistency is not pumpable, which makes it more difficult to handle. For this reason, after the completion of the chemical reaction the paper fiber stock is diluted at least enough to make it pumpable. This dilution often takes place outside the container, as dilution inside the container can lead to problems of operating reliability.

A method is known from German Patent Application No. DE 198 26 879 A1 with which the above-mentioned dilution also takes place inside the stacking container. The known method is particularly effective when two different rotors interact in the dilution area of the container. However, this additional expenditure is not possible or useful in every case. In many cases there is not enough room for the second drive, either.

German Patent Application No. DE OS 35 22 395 C1 shows a storage container (tower) for recovered paper. This is used for the chemical treatment of contaminated recovered paper that has not disintegrated. The method is therefore aimed at initially pretreating the raw material accumulated as recovered paper chemically and in a high-consistency condition so that it can subsequently be processed with a slushing rotor arranged in the base of the container. The described storage tank and the slushing rotor are thereby adjusted to and appropriately developed for the raw material that is not disintegrated and therefore yet to be disintegrated.

European Patent Application No. EP 0 475 669 B1 shows a stacking container in the base of which a dilution takes place by means of the addition of water and mixing with the aid of a propeller. Although this process makes it possible to produce a pumpable suspension, it is very nonuniform, so that, e.g., it is proposed to place pumps at different points, which tolerate the different consistencies of the suspension.

SUMMARY OF THE INVENTION

The present invention is provides a process which is a reliable possibility for stacking the high-consistency paper fiber stock, such that at the same time diluting and pumping out are to be made possible with simple and space-saving means.

The process according to the instant invention includes that, with the aid of a screw coil arranged directly in front of the rotor, a flow is generated that runs in the axial direction of the screw coil and guides the suspension away from the wire.

With the aid of the process according to the invention, a controlled dilution flow is produced underneath the high-consistency paper fiber stock, whereby a suspension is formed and pumped out through the wire device (in particular continuously). Since the wire device is provided with a rotor, clogging is avoided. In those cases where the elimination of high-consistency stock accumulations from the area above the suspension cannot be avoided, they are circulated with the aid of the rotor until they are diluted with water and have disintegrated again. Although such a repeated disintegration requires only low forces, it is necessary, as otherwise problems could occur with the stock pumps. The rotor that moves close to the wire to keep the wire clear is very well suited for applying the forces necessary during the repeated disintegration.

The formation of the suspension is supported by the screw coil arranged in front of the rotor. It can simply be set on the rotor so that it is driven by it. In the preferred exemplary embodiment, the axial conveyer effect of the screw coil is directed such that it guides the suspension at right angles to the surface of the wire and away from it. This generates shear forces and frictional forces which are gentle and yet strong enough for the disintegration process planned here.

The present invention is directed to a process for stacking and diluting paper fiber stock. The process includes stacking a high-consistency paper fiber stock in a first volume for a defined dwell time, conveying the high-consistency paper fiber stock to a second volume arranged to adjoin downstream the first volume, diluting the high-consistency paper fiber stock in the second volume at least to a pumpable consistency, and drawing off the diluted paper fiber stock as a suspension through a wire. The process also includes generating a circulation flow in the second volume, such that the circulation flow facilitates the conveying of the high-consistency paper fiber stock located on boundary of the first volume into the second volume, the diluting of the high-consistency paper fiber stock, and the drawing of the diluted paper fiber stock through the wire. The process includes rotating a rotor to keep the wire clear, and generating, with a screw coil arranged directly in front of the rotor, a flow that runs in an axial direction of the screw coil and guides the diluted suspension away from the wire.

In accordance with a feature of the present invention, the process can further include moving the screw coil with a same rotational frequency as the rotor. Further, the screw coil can be connected to the rotor.

According to another feature of the invention, a center axial line of the screw coil can be arranged horizontally.

According to still another feature of the instant invention, the high-consistency paper fiber stock can have a crumbly structure.

Further, the high-consistency paper fiber stock can be recovered paper that has been disintegrated, cleaned and subsequently thickened.

According to another feature of the invention, the high-consistency paper fiber stock in the first volume may have a solid matter content of about 20% to about 40%.

According to a further feature of the invention, the paper fiber stock drawn off from the second volume may have a maximum solid matter content of about 8%.

In accordance with a still further feature, the circulation flow can be generated by the rotor.

Moreover, the paper fiber stock can be conveyed from the first volume to the second volume through a gradually narrowing flow cross section area. A downstream flow cross sectional area of the gradually narrowing flow cross section area can be a maximum of about 80% of an upstream flow cross sectional area.

In accordance with another feature of the invention, the second volume may be located below the first volume.

The present invention is directed to a container for stacking and diluting paper fiber stock. The container includes an upper area structured and arranged to contain a first volume composed of high-consistency paper fiber stock and a lower area structured and arranged to contain a second volume. A hydraulic circulation device is located within the lower area, a dilution device is structured and arranged to dilute the paper fiber stock in the lower area, and a discharge opening is positioned to discharge accepted diluted paper fiber stock. A wire device includes at least one wire and at least one rotor, such that the at least one rotor is structured and arranged to draw the diluted paper fiber stock through the at one wire. A screw coil is mounted on the at least one rotor, and the screw coil is structured and arranged to convey the diluted paper fiber stock away from the at least one wire in an axial direction of the screw coil.

According to a feature of the invention, the screw coil can convey the diluted paper fiber stock in a horizontal direction.

In accordance with another feature of the present invention, the at least one wire can include a flat plate with openings.

According to still another feature of the instant invention, an axial height of the screw coil above the at least one rotor may be at least about 30% of an outer diameter of the at least one rotor.

In accordance with a further feature of the invention, an outer diameter of the screw coil can be at least about 20% of an outer diameter of the at least one rotor.

Further, the screw coil can have screw-shaped surfaces on a circumference oriented at an angle of between about 5° and about 30° to a normal axis surface.

According to another feature, a gradually narrowing flow cross section is located between the upper area and the lower area.

In accordance with still yet another feature of the present invention, a downstream flow cross sectional area of the gradually narrowing flow cross section area can be a maximum of about 80% of an upstream flow cross sectional area.

The present invention is directed to a process for pumping diluted paper fiber stock out of a chamber. The process includes rotating a rotor in a region of a wire to generate a circulation flow in the diluted paper fiber stock that draws the diluted paper fiber stock through the wire and to keep the wire clean, and generating, with a screw coil arranged directly in front of the rotor, a flow that runs in an axial direction of the screw coil and guides the diluted suspension away from the wire.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1–5 suggest exemplary devices for performing the inventive process, without disclosing specific structural details.

Figure 1:
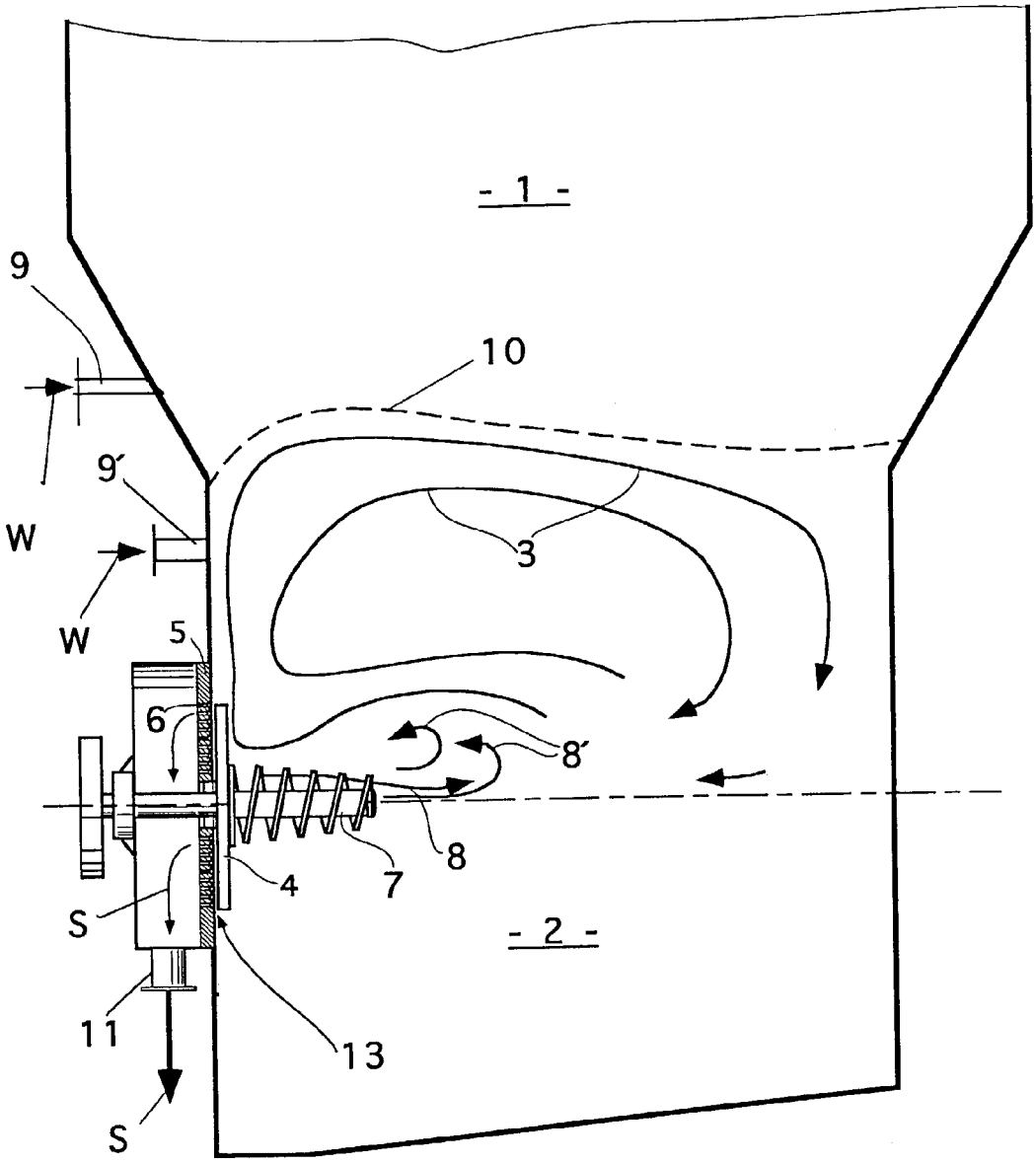
FIG. 1 illustrates a side sectional view of a container in which the process according to the invention is performed.

FIG. 1 shows the lower part of a container for stacking and diluting paper fiber stock. The container here is essentially axially symmetrical with perpendicular center line and contains a first volume 1 (only partially shown) and a second volume 2. The first volume 1 is used to hold the high-consistency paper fiber stock, which—as mentioned above—is to be stored or treated with chemicals in it. Between the two parts of the container is a transition in the shape of a truncated cone, through which the flow cross-sectional area is reduced in a downstream direction. This results in a large stacking volume and prevents the high-consistency paper fiber stock slipping down in an uncontrolled way. The boundary 10 between the high-consistency fiber stock and the diluted fiber stock in the second volume 2 is indicated by a dotted line. This is not a sharply defined area, since it is constantly changing—depending on the operating condition. Diluting water W is supplied through laterally arranged diluting water pipes 9 or 9'. The suspension present in the second volume 2 is moved by a rotor 4 in a circulation flow 3 that is merely suggested here by two arrows. The rotor 4 belongs to a wire device 13 featuring a wire 5. The wire 5 contains openings 6 through which part of the paper fiber stock moved in the second volume 2 as suspension S can pass, and which is then drawn off via the accepted stock duct 11. The rotor 4 is here embodied as, e.g., an impeller rotor that is moved along in the direct proximity of the wire 5, i.e., at a distance between 1 and 10 mm. In addition to keeping the wire 5 clear, the impeller rotor is also used to generate a circulating flow which, as with a pump impeller, suctions in the liquid centrally and accelerates it radially. Moreover, a purely rotational movement is superimposed on this movement, which rotational movement cannot be shown in this side view, but which will be described later.

The screw coil 7 is arranged in front of the rotor 4, i.e., on the side of it not facing the wire 5. Here it is attached to the rotor 4 concentrically with it, and thus turns with the same rotational frequency. It is embodied such that with its rotational movement it generates a flow 8, which conveys the suspension in the direction of the axis of the screw coil 7 and away from the wire 5. In interaction with the circulation flow 3 rotating in the opposite direction, turbulent flows 8' form with the positive effects already mentioned.

The addition of the diluting water W can be carried out, e.g., through the addition pipe 9 into the thickened fiber stock or through the addition pipe 9' into the area of the circulation flow 3, immediately before it reaches the boundary 10.

Figure 2:
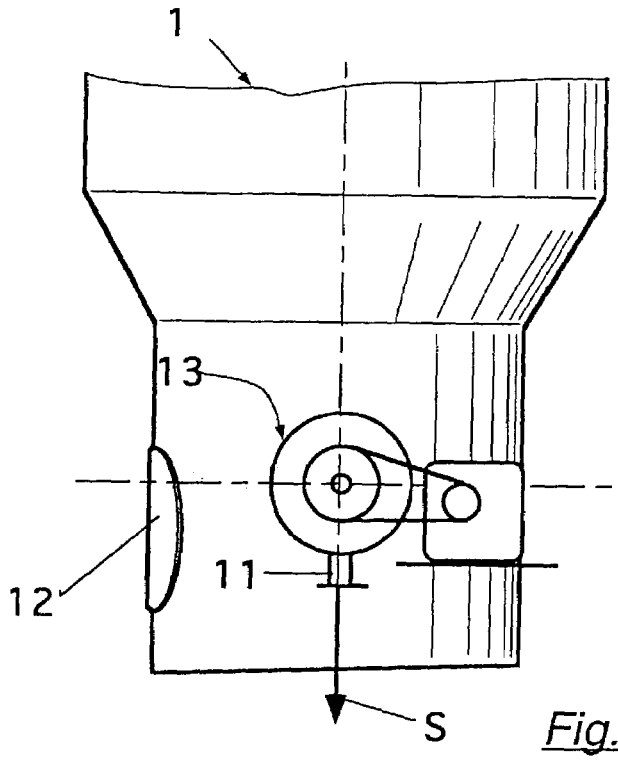
FIG. 2 illustrates another side view of the subject matter depicted in FIG. 1.
Figure 3:
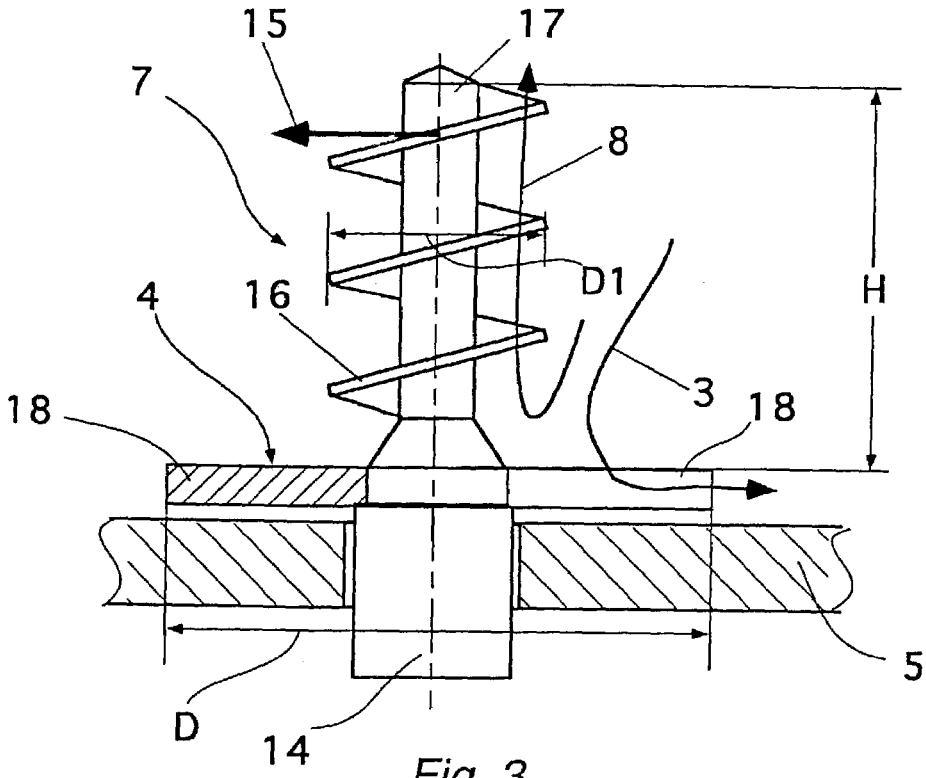
FIG. 3 illustrates the area of the rotor depicted in FIG. 1 in more detail.

FIG. 2 shows the lower part of the container in a view from the outside that is displaced by 90° relative to that in FIG. 1. Essentially it shows the outer part of the wire device 13 and the accepted stock ducts 11 for the channeled out suspension S. A removable cap 12 is also drawn here, which covers a manhole, which facilitates the maintenance and any repairs in this area.

In order to be able to better represent the flow processes in the area of the screw coil and rotor, this area is shown again in FIG. 3, although again no structural details can be seen here. A shaft 14 is guided through the wire 5 (shown only in part and without wire openings), which shaft here drives both the rotor 4 and the screw coil 7. The axial height H of the screw coil 7, with which it projects above the rotor 4, preferably corresponds to at least about 30% of the outer diameter D of the rotor 4. The outer diameter D1 of the screw coil 7 can be selected so that it is at least about 20% of the outer diameter D of the rotor 4. The rotational direction is indicated by the movement arrow 15, which refers to a part of the screw coil that is facing the observer of this Figure. With such a rotational direction, a flow 8 is formed due to the screw geometry, which flow 8 transports the suspension in the direction of the axis of this screw coil away from the wire 5. The manufacture of such a screw coil is known per se. It can be produced, e.g., by welding a screw-shaped surface 16 onto a core 17. However, this should be considered merely as an example. The rotor 4 can advantageously feature a number of blades 18 that generate a conveyor effect from the radial inside to the radial outside as a result of their rotation. In hydraulic terms, this is comparable to the effect of a fan pump. The wire 5 is constructed as a flat, circular disk, and thus is easy to produce and space-saving.

Figure 4:
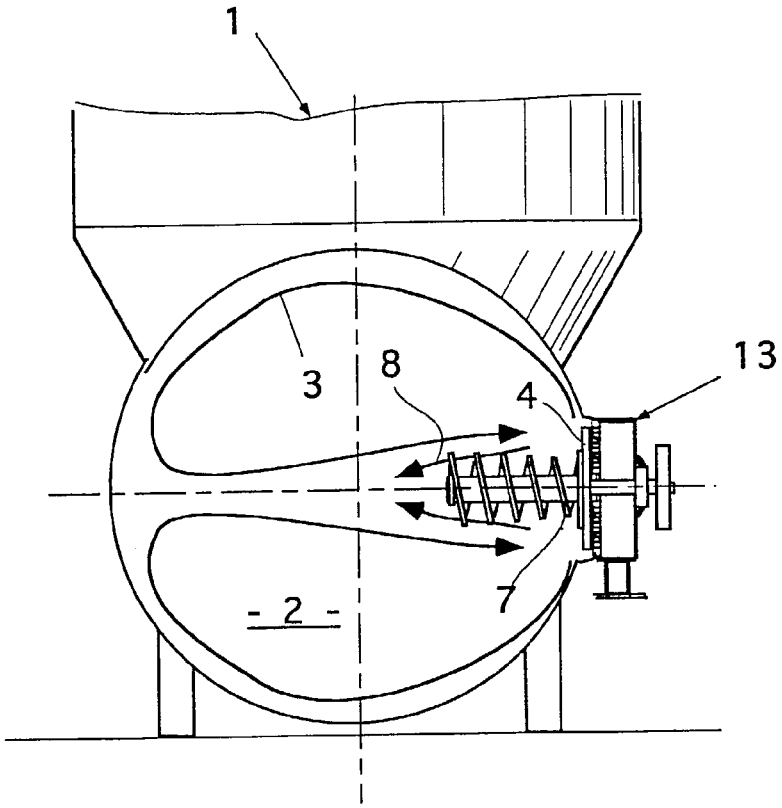
FIGS. 4 and 5 each illustrate alternative embodiments utilizing different shaped containers.
Figure 5:
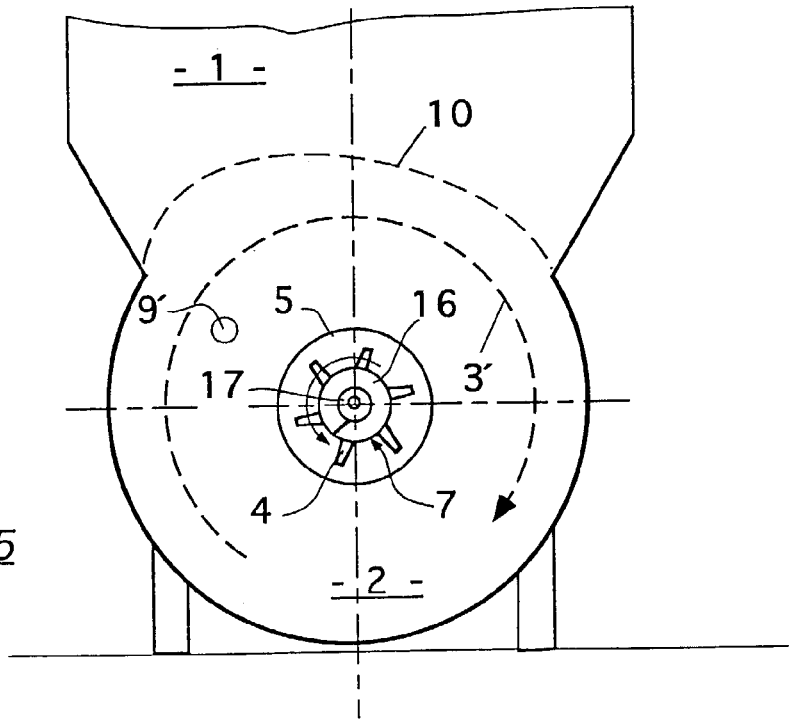

While the container shown in FIGS. 1 and 2 essentially features a cylindrical form with a truncated cone inserted in between, as FIG. 4 shows, the second volume 2 can be formed by a horizontal cylinder, to the cylinder wall of which the wire device 13 is attached. Consequently the circulation flow 3 can form particularly favorably in the circumferential direction, which possibly promotes the detachment of the high-consistency fiber stock at the boundary 10.

As already mentioned, the circulation flow 3 also contains a rotation component 3', which has essentially the same center line as the rotor 4. With the embodiment shown in FIG. 5, a horizontal cylinder is used for the volume 2, on the front side of which rotor 4 and screw coil 7 are arranged.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for stacking and diluting paper fiber stock comprising:

stacking a high-consistency paper fiber stock in a first volume for a defined dwell time;

conveying the high-consistency paper fiber stock to a second volume arranged to adjoin downstream the first volume;

diluting the high-consistency paper fiber stock in the second volume at least to a pumpable consistency;

drawing off the diluted paper fiber stock as a suspension through a wire;

generating a circulation flow in the second volume, whereby the circulation flow facilitates the conveying of the high-consistency paper fiber stock located on boundary of the first volume into the second volume, the diluting of the high-consistency paper fiber stock, and the drawing of the diluted paper fiber stock through the wire;

rotating a rotor to keep the wire clear; and generating, with a screw coil arranged directly in front of the rotor, a flow that runs in an axial direction of the screw coil and guides the diluted suspension away from the wire.

2. The process in accordance with claim 1, further comprising moving the screw coil with a same rotational frequency as the rotor.

3. The process in accordance with claim 2, wherein the screw coil is connected to the rotor.

4. The process in accordance with claim 1, wherein a center axial line of the screw coil is arranged horizontally.

5. The process in accordance with claim 1, wherein the high-consistency paper fiber stock has a crumbly structure.

6. The process in accordance with claim 1, wherein the high-consistency paper fiber stock is recovered paper that has been disintegrated, cleaned and subsequently thickened.

7. The process in accordance with claim 1, wherein the high-consistency paper fiber stock in the first volume has a solid matter content of about 20% to about 40%.

8. The process in accordance with claim 1, wherein the paper fiber stock drawn off from the second volume has a maximum solid matter content of about 8%.

9. The process in accordance with claim 1, wherein the circulation flow is generated by the rotor.

10. The process in accordance with claim 1, wherein the paper fiber stock is conveyed from the first volume to the second volume through a gradually narrowing flow cross section area.

11. The process in accordance with claim 10, wherein a downstream flow cross sectional area of the gradually narrowing flow cross section area is a maximum of about 80% of an upstream flow cross sectional area.

12. The process in accordance with claim 1, wherein the second volume is located below the first volume.

13. A process for pumping diluted paper fiber stock out of a chamber comprising:

rotating a rotor in a region of a wire to generate a circulation flow in the diluted paper fiber stock that draws the diluted paper fiber stock through the wire and to keep the wire clean; and generating, with a screw coil arranged directly in front of the rotor, a flow that runs in an axial direction of the screw coil and guides the diluted suspension away from the wire.

* * * * *